US008495768B2

(12) United States Patent
Owen, Jr.

(10) Patent No.: US 8,495,768 B2
(45) Date of Patent: Jul. 30, 2013

(54) FOOT ACTUATED TOILET SEAT LIFTING AND SELF-LOWERING MECHANISM

(76) Inventor: James Leon Owen, Jr., Forrest City, AR (US)

( * ) Notice: Subject to any disclaimer, the term of this patent is extended or adjusted under 35 U.S.C. 154(b) by 349 days.

(21) Appl. No.: 12/800,957

(22) Filed: May 26, 2010

(65) Prior Publication Data

US 2011/0289666 A1 Dec. 1, 2011

(51) Int. Cl.
*A47K 13/10* (2006.01)

(52) U.S. Cl.
USPC ..... 4/246.1

(58) Field of Classification Search
USPC ..... 4/246.1–246.5, 242.1, 243.1
See application file for complete search history.

(56) References Cited

U.S. PATENT DOCUMENTS

| | | | |
|---|---|---|---|
| 4,807,307 | A | 2/1989 | Sato et al. |
| 5,103,506 | A | 4/1992 | Munford et al. |
| 5,237,708 | A | 8/1993 | Zamoyski |
| 5,444,877 | A | 8/1995 | Kumarasurier |
| 5,487,192 | A | 1/1996 | Hodges |
| 5,488,743 | A | 2/1996 | Alfonso |
| 5,829,068 | A | 11/1998 | Smith |
| 5,857,223 | A | 1/1999 | Ferdinand |
| 5,875,498 | A | 3/1999 | Joseph |
| 6,233,751 | B1 | 5/2001 | Ford |
| 6,393,623 | B1 | 5/2002 | Strickland, Jr. |
| 6,470,503 | B1 | 10/2002 | Holmes |
| 6,807,687 | B2 | 10/2004 | Marras |
| 2004/0172744 | A1 | 9/2004 | Mills |
| 2008/0189843 | A1 | 8/2008 | Isaac |

FOREIGN PATENT DOCUMENTS

| | | | |
|---|---|---|---|
| GB | 2171426 | A | 8/1986 |
| GB | 2187769 | A | 9/1987 |

OTHER PUBLICATIONS

Wang, CN;ZHE products, Sunny & Beauty International Trading Co., Oct. 25, 2009, Zhejiang China.

*Primary Examiner* — Lori Baker

(57) ABSTRACT

A mechanism (100) composed of three primary assembled components, a housing assembly (10), a cable assembly (50), and a lift arm assembly (70) that work in unison to lift a toilet seat (102) via the application of pressure to a foot pedal (32).

1 Claim, 7 Drawing Sheets

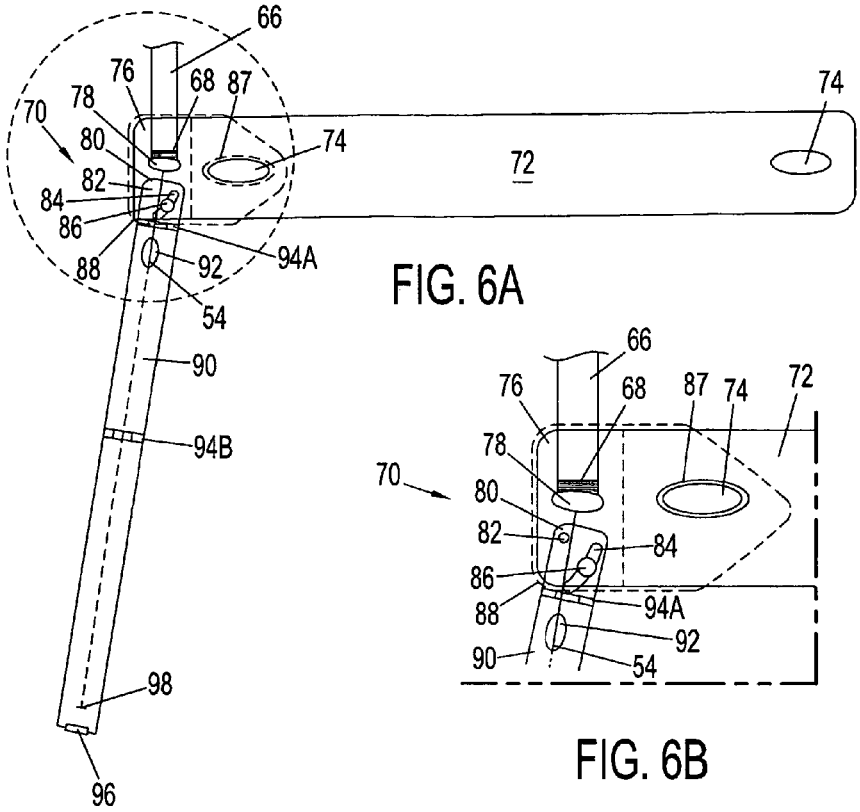
FIG. 6A
FIG. 6B
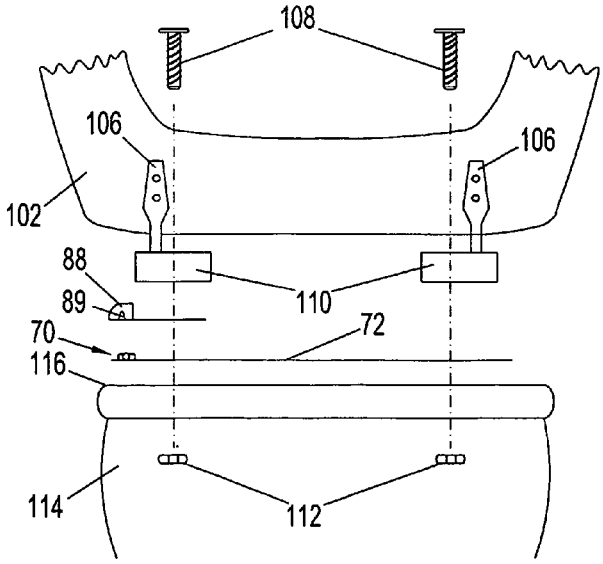
FIG. 7

FOOT ACTUATED TOILET SEAT LIFTING AND SELF-LOWERING MECHANISM

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field

This application relates generally to the field of toilet accessories, and more specifically, to toilet seat or seat/lid lifters operated by application of pressure to a foot pedal.

2. Prior Art

To the inventor's knowledge, there exists no commercially available foot actuated toilet seat or seat/lid lifting and self-lowering mechanism which avoids the associated sanitary problems while simultaneously meeting minimum child safety standards.

Numerous devices for raising the toilet seat without a person using their hands have been conceived, devised, and patented, but none have been generally accepted by manufacturers or the public. This lack of acceptance and use is due, at least in part, to several disadvantages inherent in the design of prior art devices. Apparent disadvantages extend to, but are not limited to, mechanical complexities which require elaborate installation procedures or modifications that are commercially unviable. Although most of the prior art devices are functional in lifting the toilet seat, they fail to provide features such as 1) Universal application to most all commercial and domestic toilets without any modifications to the toilet itself or any adjoining floor or wall structures; 2) Ergonomically enhance the toilet's features without obtrusive or dangerous appendiges; and most importantly, 3) maintain a level of safety for users, especially children, that ensures acceptance by manufacturers and use by the general public.

By way of example, the prior art discloses in U.S. Pat. No. 5,237,708 of Zamoyski a foot actuated toilet seat lifting and lowering device.

- U.S. Pat. No. 5,487,192 of Hodges discloses a foot actuated toilet seat lifting and self-lowering apparatus.
- U.S. Pat. No. 6,470,503B1 of Holmes discloses a foot actuated device for lifting a toilet seat.
- U.S. Pat. No. 5,829,068 of Smith discloses a toilet seat raising and lowering device.
- U.S. Pat. No. 5,488,743 of Alfonso discloses a mechanical apparatus used to lift and lower the lid and seat of a toilet by way of pedal.

These previously listed prior art devises are only a few that exist in this field, but serve as an example of the various designs and constructions heretofore devised and utilized for the purpose of raising and lowering toilet seats that share the common traits of familiar, expected, and obvious structural configurations that are mechanically complex, obtrusive, limited in their applications, and pose hazards to users, specifically children.

Therefore, it can be appreciated that there exists a continuing need for a new and improved mechanism for raising and self-lowering of a toilet seat or seat/lid through the use of a foot pedal, while providing manufacturers with a commercially viable product and providing the general public with a universally adaptable, inexpensive, readily installable, and ergonomically advanced mechanism that will perform its task efficiently, and most importantly, safely.

OBJECTS AND ADVANTAGES

Accordingly, an objective of the disclosed mechanism is to provide a foot actuated mechanism to raise and allow for self-lowering of the seat or seat/lid proportionally with the pressure applied by the user's foot while overcoming all of the disadvantages associated with previously devised prior art.

Another objective of the disclosed mechanism is to provide a means for avoiding unsanitary contact with the toilet seat/lid minimizing transmittal of various viral and bacteriological diseases.

A further objective of the disclosed mechanism is to be universally adaptable to most all domestic and commercial toilets whether they are self-supporting, wall-hung, or handicapped accessible.

Still another objective of the disclosed mechanism is that it encompasses the ability to be placed in the males' comfort zone while standing, and not become obtrusive when a male or female user is in a sitting position.

Yet another objective of the disclosed mechanism is to provide a toilet seat or seat/lid lifting and self-lowering mechanism that can be efficiently manufactured, distributed, and sold at a low cost to the public.

Still another objective of the disclosed mechanism is to provide a product to the general public that can be easily installed by most anyone without any modifications whatsoever to the toilet, adjoining floor, or wall.

Still another objective of the disclosed mechanism is that it features the versatility to place the foot pedal housing unit on either side of the toilet, either hiding it from view or allowing its ergonomic design to be recognized and utilized.

Lastly, it is another objective of the disclosed mechanism to meet the aforesaid listed objectives while providing a level of safety that has never before been attained.

These together with other objectives of the herein disclosed mechanism, along with the various features of novelty which characterize the herein disclosed mechanism, are pointed out with particularity in the claims annexed to and forming a part of this application. For a better understanding of the disclosed mechanism, its operating advantages and the specific objectives attained by its utilization, reference should be made to the accompanying drawings and descriptive matter which illustrate the novel features of its preferred embodiment.

SUMMARY

The disclosed mechanism provides novel features that will result in a evolutionary journey towards accomplishing the task it is designed for and performing that task in a safe manner.

In view of the disadvantages inherent in the known types of toilet seat lifting devices now present in the prior art, the disclosed mechanism is designed to perform the function of lifting and allowing the self-lowering of a toilet seat/lid without the features being anticipated or rendered obvious.

To attain this, the disclosed mechanism generally comprises three assembled components that work in unison to provide a system of lifting and allowing self-lowering of a toilet seat/lid by the utilization of a foot pedal. The first element is the housing unit assembly from which the foot pedal protrudes. When the foot pedal is engaged, the second element, a sleeved cable which couples the first and third elements, directly engages the third element which is a lift-arm assembly, hence raising the toilet seat or seat/lid proportionally with the pressure applied to the foot pedal.

With regards to manufacturing costs, the entire system is so simplistically designed that manufacturing, assembly, and distribution of the system will render it commercially viable. Costs associated with this mechanism will be such that it would not be prohibitive to consumers in private homes or commercial venues such as public restrooms, schools, hospitals, restaurants, etc.

Regarding installation of the mechanism, no special parts nor any modifications will be necessary. Anyone skilled enough to handle a screwdriver will be able to install it, unless it is being mounted to a floor surface such as tile, marble, or concrete where it will require two (2) holes to be drilled first for the placement of screw tappits.

Furthermore, with society becoming more ecologically minded and demanding ergonomically advanced enhancements, the disclosed mechanism is able to meet these higher standards. Whether it is the newly designed water-conserving MAXWELL DUAL FLUSH manufactured by GERBER, the organically styled ENSO SUITE manufactured by MANSFIELD, the DRAKE II manufactured by TOTO USA, the ZIGA ZAGA manufactured by DANZE, or the other advanced designs provided by AMERICAN STANDARD, KOHLER, and others, the disclosed mechanism will readily adapt to and integrate with these state of the art toilet designs now available to the public.

There has thus been outlined, rather broadly, the more important features of the disclosed mechanism in order that the detailed description thereof that follows may be better understood and appreciated.

In this respect, before explaining at least one embodiment of the disclosed mechanism, it is to be understood that the mechanism is not limited in its application to the details of construction and arrangement of components set forth in the following description or illustration in the drawings. The disclosed mechanism is capable of other embodiments and of being utilized in various ways. Also, it is to be understood that the phraseology and terminology employed herein are for the purpose of description and should not be regarded as limiting.

BRIEF DESCRIPTION OF THE DRAWINGS

The disclosed mechanism will be better understood and objects other than those set forth above will become apparent when consideration is given to the following detailed description thereof. Such description makes reference to the annexed drawings wherein:

FIG. 6A is a plan view of the stabilizer brace/lift arm assembly at rest position.

FIG. 6B is a enlarged view of a portion of FIG. 6A showing details of the lift arm extension and swing arm brace assembly.

FIG. 7 is a front elevational view showing the installation placement of the stabilizer brace/lift arm assembly and safety cap relative to the toilet bowl and toilet seat mounting brackets.

DRAWINGS

Reference Numerals

10 Housing Unit Assembly
12 Housing Body
14A Mounted Axle/Guide Spacer
14B Mounted Axle/Guide Spacer
14C Mounted Axle/Guide Spacer.
15 Cover Plate
16A Cover Plate Mounted Guide Spacer
16B Cover Plate Mounted Guide Spacer
16C Cover PLate Mounted Guide Spacer
17 Cover Plate Screws (4)
18 Cover Plate Screw Holes (8)
20 Housing Anchor Plate Assembly
22 Anchor Plate
24 Anchor Plate Floor Screws (2)
25 Anchor Plate Floor Screw Holes (2)
26 Anchor Plate Mounting Screws (4)
28 Anchor Plate Mounting Screw Holes (8)
30 Foot Pedal/Arm/Drive Gear Assembly
32 Foot Pedal
33 Drive Gear Arm
34 Drive Gear Wheel
36 Drive Gear Teeth
37 Drive Gear Spring Housing Body Connector/Gaff
38 Drive Gear Spring
39 Drive Gear Spring Gear Wheel Connector/Gaff
40 Cable Pulley Assembly
42 Cable Pulley
44 Spur Gear
46 Spur Gear Teeth
48 Cable Pulley Connector Slot
50 Cable/Sleeve/Adjustment Arm Assembly

Figure 5A:
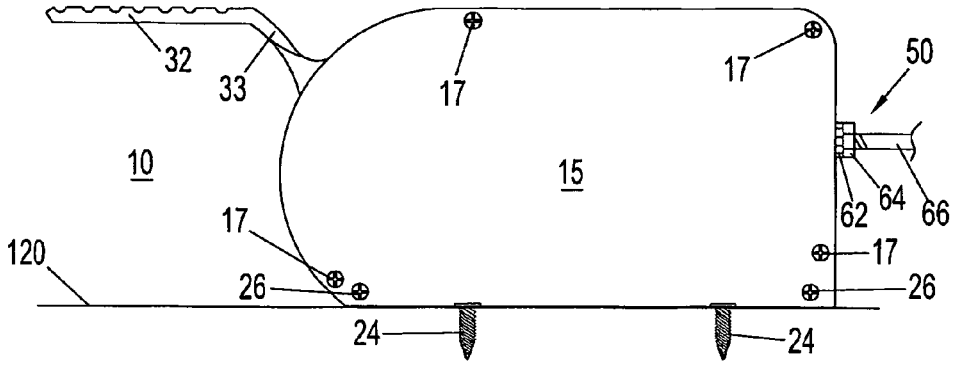
FIG. 5A is a right elevational view of a foot pedal's housing unit fully assembled and stabilized demonstrating its aesthetic appearance.
Figure 5B:
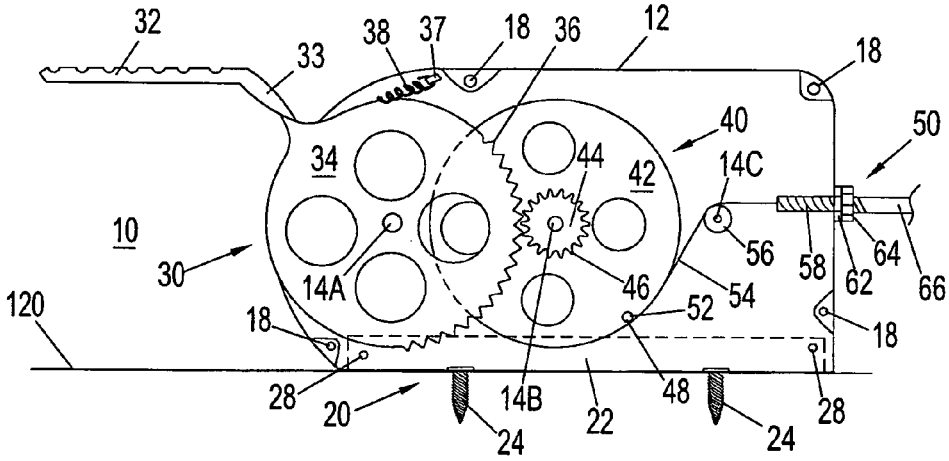
FIG. 5B is a right elevational view of the foot pedal's housing unit with the cover plate removed showing details of the mounted foot pedal/drive gear, mounted cable pulley, mounted guide pulley, and cable adjustment arm assembly at rest position.
Figure 5C:
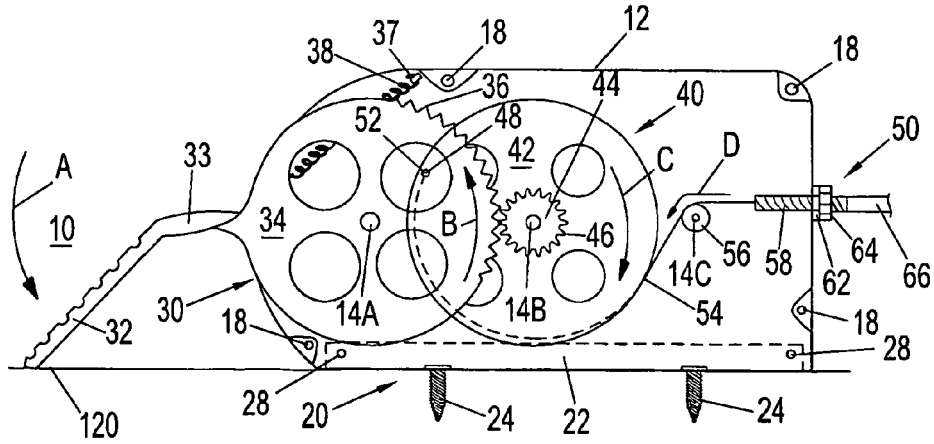
FIG. 5C is a right elevational view of the foot pedal's housing unit showing details relative to motion of the mounted foot pedal/drive gear, mounted cable pulley, mounted guide pulley, and cable adjustment arm assembly when the pedal force has been applied.

52 Cable End Connector
54 Cable
56 Cable Guide Pulley
58 Cable Sleeve Adjustment Arm
60 Cable Sleeve Adjustment Arm Hole (1)
62 Adjustment Arm Nut
64 Adjustment Arm Lock Nut
66 Cable Sleeve
68 Cable Sleeve End
70 Lift Arm/Stabilizer Brace Assembly
72 Stabilizer Brace
74 Stabilizer Brace Holes (2)
76 Stabilizer Brace Extension
78 Mounted Cable Sleeve End Eye
80 Swing Arm Brace Plate
82 Swing Arm
84 Swing Arm Brace Plate Hole (1)
86 Swing Arm Brace Plate Adjustment Nut (1)
88 Safety Cap
89 Safety Cap Cable Eye
90 Lift Arm
92 Lift Arm Cable Eye
94A Lift Arm Hinge
94B Lift Arm Hinge
96 Lift Arm Roller
98 Lift Arm Cable End Connector/Gaff
100 Foot Actuated Toilet Seat/Lid Lifting & Self-Lowering System
101 Toilet Tank
102 Toilet Seat
104 Toilet Seat Lid
105 Toilet General Assembly
106 Toilet Seat/Lid Hinges
108 Toilet Seat/Lid Attachment Bracket Bolts (2)
110 Toilet Seat/Lid Attachment Brackets (2)
112 Toilet Seat/Lid Attachment Bracket Nuts (2)
114 Toilet Bowl
116 Toilet Bowl Rim
118 Toilet Base
120 Floor
FIG. 5C Arrows A, B, C, and D indicate directional movement

DETAILED DESCRIPTION OF PREFERRED EMBODIMENT

In accordance with one embodiment of the disclosed mechanism, a foot actuated toilet seat or seat/lid lifting and self-lowering system generally designated by the reference numeral 100 will now be described in detail.

Figure 1:
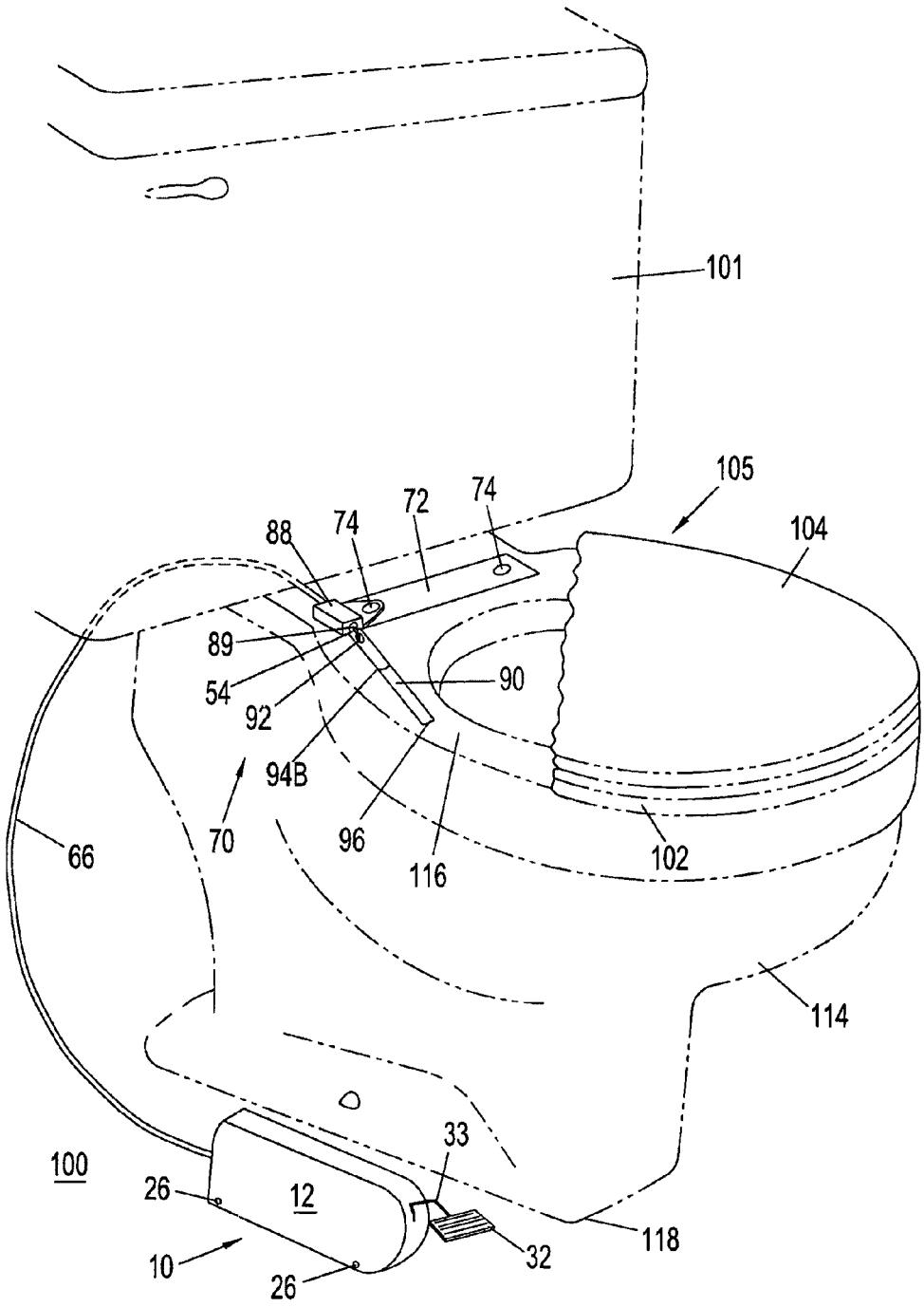
FIG. 1 is a front perspective view of a typical toilet having a seat/lid with a substantial portion of the seat/lid removed so that one can see the entire system without obstruction.

FIG. 1 illustrates the system 100 in its entirety and the placement of its primary assembled components. A substantial portion of a toilet seat 102, toilet seat lid 104, and their attachment components have been removed so that the entire system 100 can be viewed without obstruction. The system 100 is comprised of a housing unit assembly generally referenced to as 10, a cable/sleeve/adjustment arm assembly generally referenced to as 50, and a lift arm/stabilizer brace assembly generally referenced to as 70. The housing unit assembly 10 has been anchored (shown in FIGS. 4A, 4B, 5A, 5B, & 5C) on the left side of a toilet generally referenced to as 105. The housing assembly 10 sits on a floor 120 parallel to a toilet's base 118. This allows a cable 54 inside a cable sleeve 66 to run along side a toilet bowl 114 up to the bottom of a toilet tank 101 and then between the toilet tank 101 and a toilet bowl rim 116 to emerge along the top of the toilet bowl rim 116 thereby connecting with the lift arm assembly 70 which lies on top of the toilet bowl rim 116 in a horizontal position. The system pellucidly demonstrates one of its many novel features such as the versatility of the cable sleeve 66 which allows the housing assembly 10 to virtually be placed anywhere within the proximity of the toilet 105, whether it be to the left side or the right side.

Figure 2:
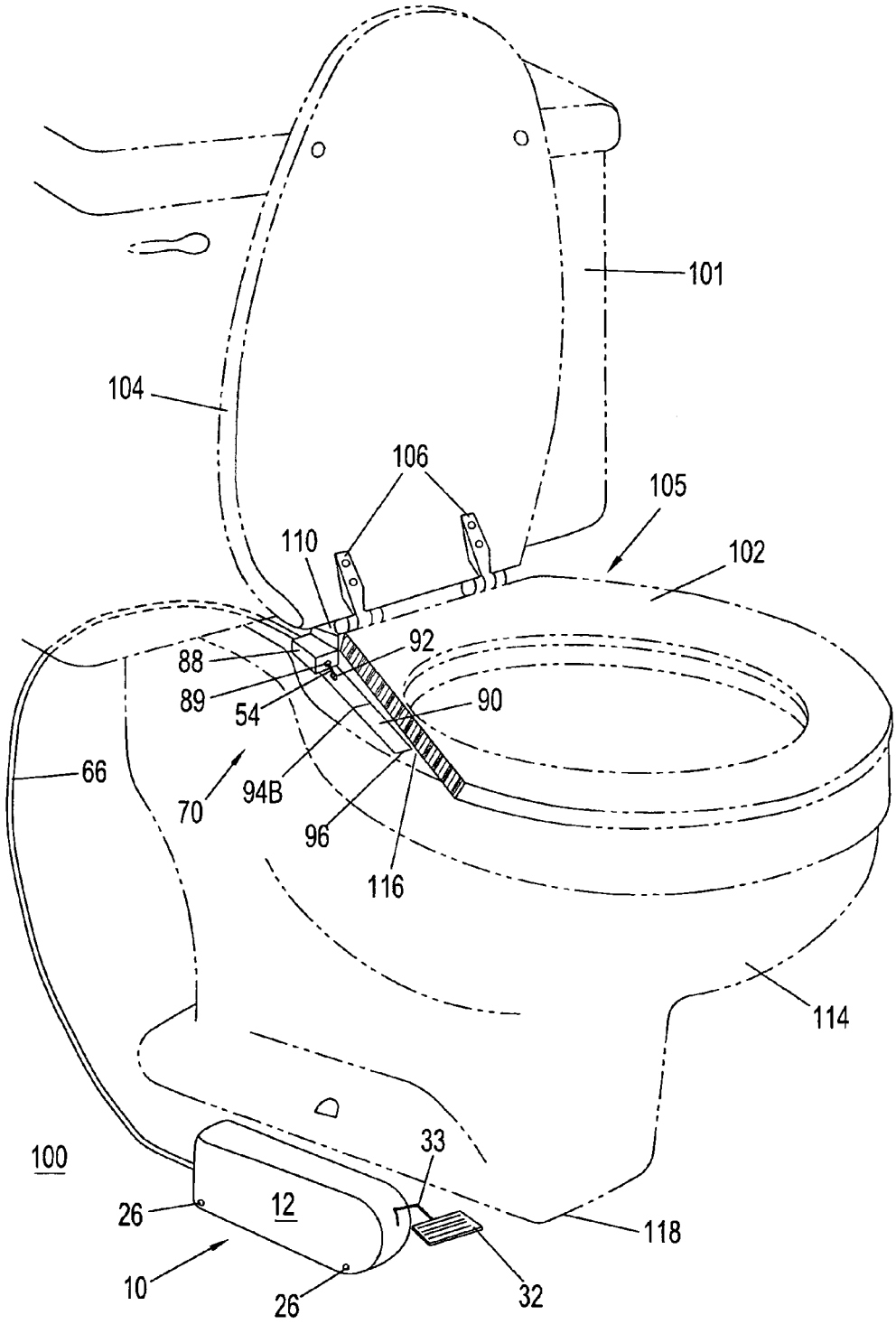
FIG. 2 is a front perspective view of the toilet with the disclosed mechanism at rest position with a smaller portion of the seat/lid removed for clarity of positioned components.

FIG. 2 illustrates a larger portion of the toilet seat 102, toilet seat lid 104, and their attachment components in place to more accurately depict the placement of the lift arm assembly 70 in its relative position. The lift arm assembly 70 has a safety cap 88, another of its novel features, that can be seen clearly butted against a toilet seat/lid attachment bracket 110 providing safety and an aesthetic appearance.

Figure 3:
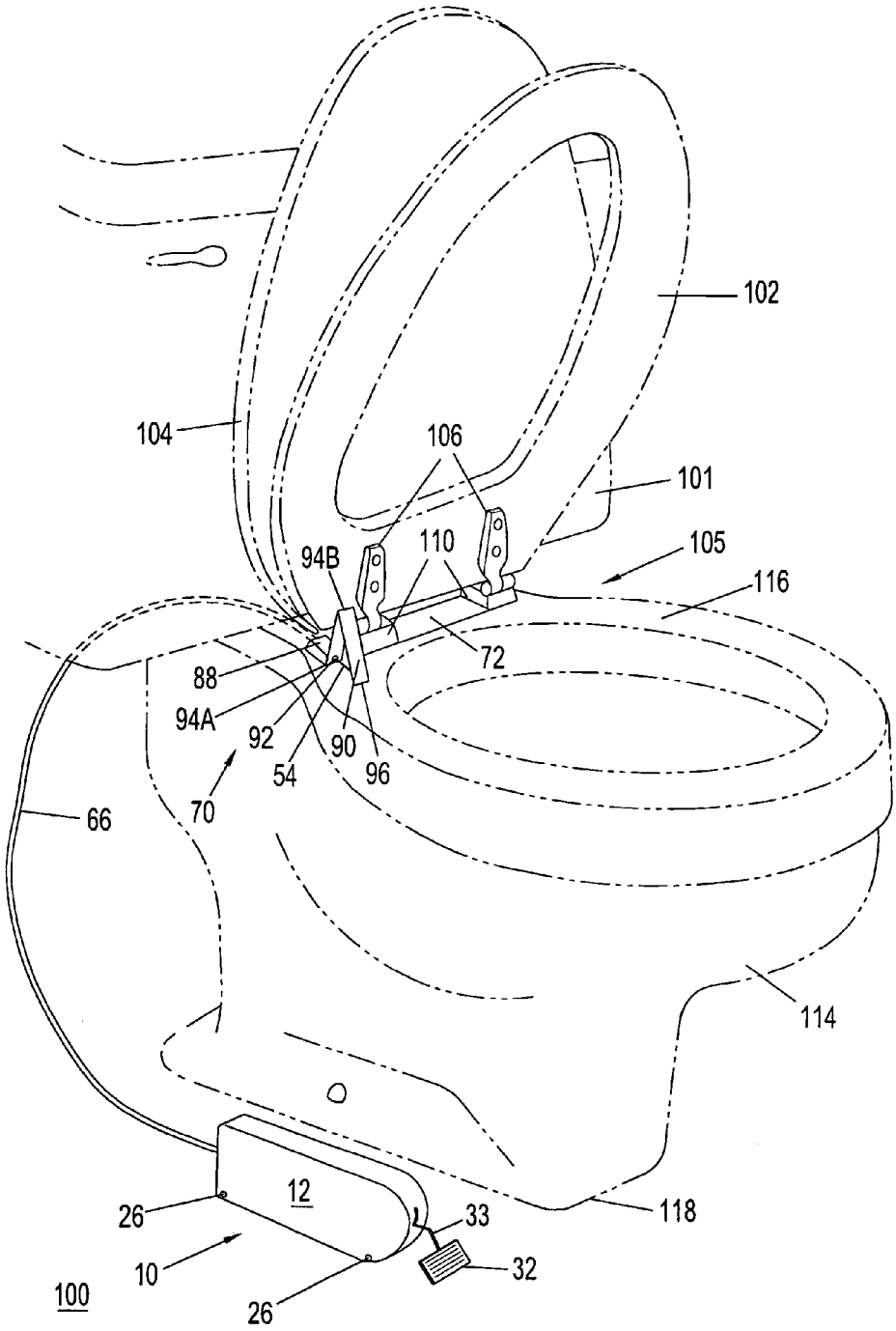
FIG. 3 is a front perspective view of the toilet and disclosed mechanism that illustrates geometric position of the components in operating position relative to the toilet when the toilet seat has been lifted to a predetermined angle with respect to the toilet bowl by applying the pedal force.

FIG. 3 illustrates the system 100 in its designed operational position. When force is applied to a foot pedal 32 it assumes an "down position" while the toilet seat 102 assumes an "up position". The retraction of the cable 54 has caused a lift arm 90 to attain its maximum operational position, hence holding the toilet seat 102 in its designed predetermined angle of approximately 75° to 80° relative to the toilet bowl rim 116.

Figure 4A:
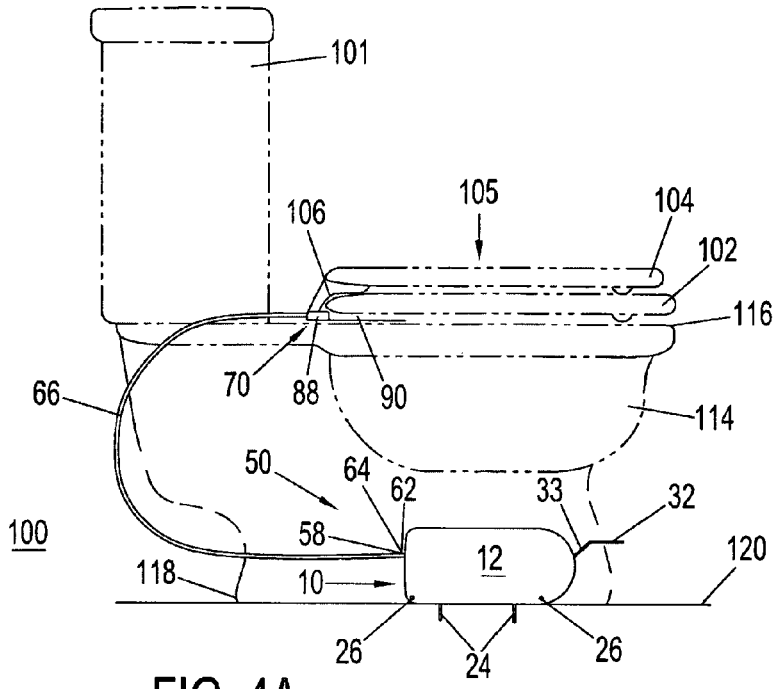
FIG. 4A is a left elevational view of the toilet and disclosed mechanism that illustrates the proportional size of the components relative to the toilet when the mechanism is at rest position while also demonstrating the optimal positioning of the housing unit assembly.

FIG. 4A illustrates the proportional dimensions of the housing assembly 10 in contrast to the toilet bowl 114. A housing body 12 length is approximately 19 cm (7.5 inches) with a protruding foot pedal 32 and arm 33 adding an additional 7 cm (2.75 inches) for a total length of approximately 26 cm (10.25 inches). The housing body 12 height is approximately 9 cm (3.5 inches). With the toilet bowl 114 being approximately 43 cm (17 inches) in length and approximately 35.5 cm (14 inches) in height from base 118 to rim 116, it is readily apparent that the housing assembly 10 is approximately one tenth (1/10) the size of the toilet bowl 114. Thus, another novel feature shown in FIGS. 4A and 4B is the housing assembly's 10 compact size.

Figure 4B:
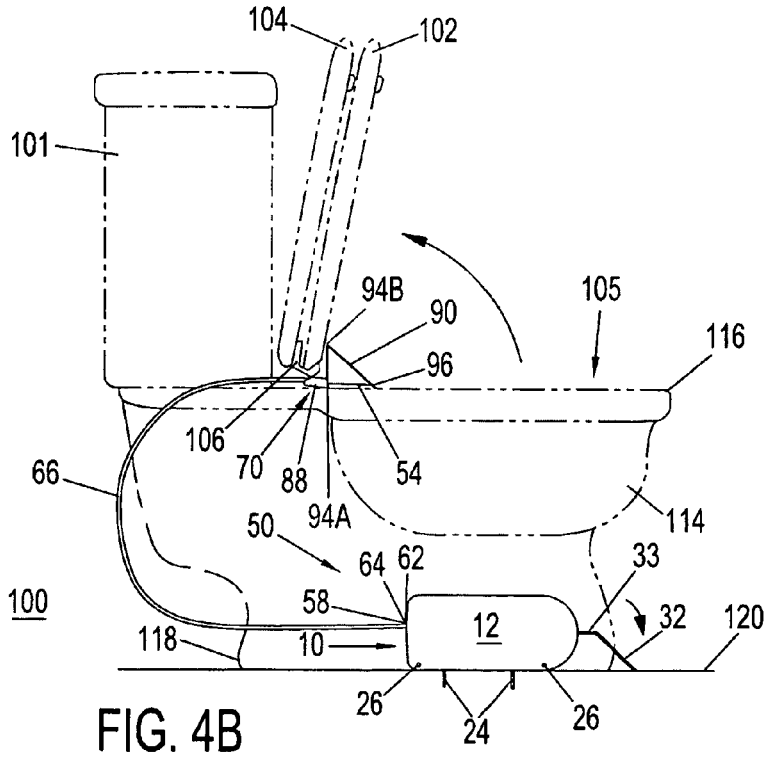
FIG. 4B is a left elevational view of the toilet and disclosed mechanism that illustrates relative geometric position of the components in operating position wherein the toilet seat/lid has been lifted to a predetermined angle with respect to the toilet bowl by applying the pedal force.

FIG. 4B illustrates the relative geometrical position of the system's 100 components in their designed operational positions. Furthermore, the housing assembly 10 demonstrates another novel feature as it is positioned where a person standing could easily make use of the system 100 and would not be obtrusive were a person to assume a sitting position (not shown). Research demonstrated that the male user tends to stand slightly over the toilet 105 when urinating, hence the placement of the feet being on each side of and slightly rearward towards the rear portion of the toilet 105. Both FIGS. 4A and 4B show the optimal placement for the housing assembly 10.

FIG. 5A illustrates the ergonomically advanced housing assembly 10 anchored to the floor 120 by anchor screws 24 and at rest position. The enclosed housing body 12 provides still another novel feature by safely covering the mechanical interior while providing an exterior that can be easily cleaned.

FIG. 5B illustrates the interior of the housing assembly 10 in greater detail showing a cover plate 15 removed from its housing body 12. The housing assembly 10 is composed of a foot pedal/arm/drive gear assembly generally referenced to as 30, a cable pulley assembly generally referenced to as 40, and a cable/sleeve/adjustment arm assembly generally referenced to as 50. Starting from the far left and proceeding to the right is a foot pedal 32, a arm 33, and a drive gear wheel 34 which together form one unit mounted onto a axle 14A and held in rest position by a drive gear wheel spring 38. The rearward portion of the drive gear wheel 34, opposite the foot pedal 32, has gear teeth 36 that are aligned and mesh with gear teeth 46 of a spur gear 44 which projects outward from a cable pulley 42 which is also mounted onto a axle 14B. The cable pulley 42 has a cable end connector slot 48 which allows for connection of a cable end connector 52. The cable pulley 42 has a valley groove (shown in FIG. 8) along its outer edge allowing for alignment of the cable 54 with a cable guide pulley 56 mounted on axle 14C, which also has a valley groove along its outer edge (shown in FIG. 8) and further aligns the cable 54 with a adjustment arm 58. The cable 54 then proceeds along through a cable sleeve 66. Located outside the housing body 12 and on the adjustment arm 58 itself are a adjustment nut 62 and a adjustment lock nut 64 comprising most of the cable adjustment arm assembly 50.

FIG. 5C illustrates the housing assembly 10 in its operational position depicting the geometrical position of its assembled parts relative to motion. FIGS. 5B and 5C will be discussed in further detail in the OPERATIONAL DESCRIPTION OF PREFERRED EMBODIMENT section appended hereto.

FIG. 6A illustrates the lift arm assembly 70 and its components in rest position. A primary component of the lift arm assembly 70 is a stabilizer brace 72. The stabilizer brace 72 provides a extension 76 which allows for the connection of the cable sleeve 66 via the uniting of a cable sleeve end 68 to a mounted cable sleeve end eye 78. A swing arm brace plate 80 is connected by a swing arm 82 to the stabilizer brace plate 72. The swing arm brace plate 80 is held in position by a adjustment nut 86 and the entire stabilizer brace extension 76 with its combined components are covered by a safety cap 88. The cable 54 extends through a safety cap cable eye 89 (shown in FIG. 7) and continues onward through a lift arm cable eye 92. A lift arm 90 is connected to the swing arm brace plate assembly 70 by a hinge 94A. The lift arm 90 is approximately 12.5 cm (5 inches) in length and is separated into two (2) different lengths by a second hinge 94B. The lift arm section immediately connected to the stabilizer brace 72 is approximately 5 cm (2 inches) in length while the furthest section of the lift arm 90 is approximately 7.5 cm (3 inches) in length. The lift arm 90 ends with a roller pin 96 and provides a gaff 98 for connecting the cable end, hence completing the entire foot actuated lifting and self-lowering system 100.

FIG. 6B is an enlarged view of the stabilizer brace extension 76 and its combined components forming the lift arm/stabilizer brace assembly 70.

FIG. 7 illustrates the installation process position of the lift arm/stabilizer brace assembly 70 and its safety cap 88 relative to the toilet seat attachment brackets 110 and the toilet bowl rim 116. Further discussion of FIG. 7 will be held in the Consumer Installation Procedure section appended hereto.

Figure 8:
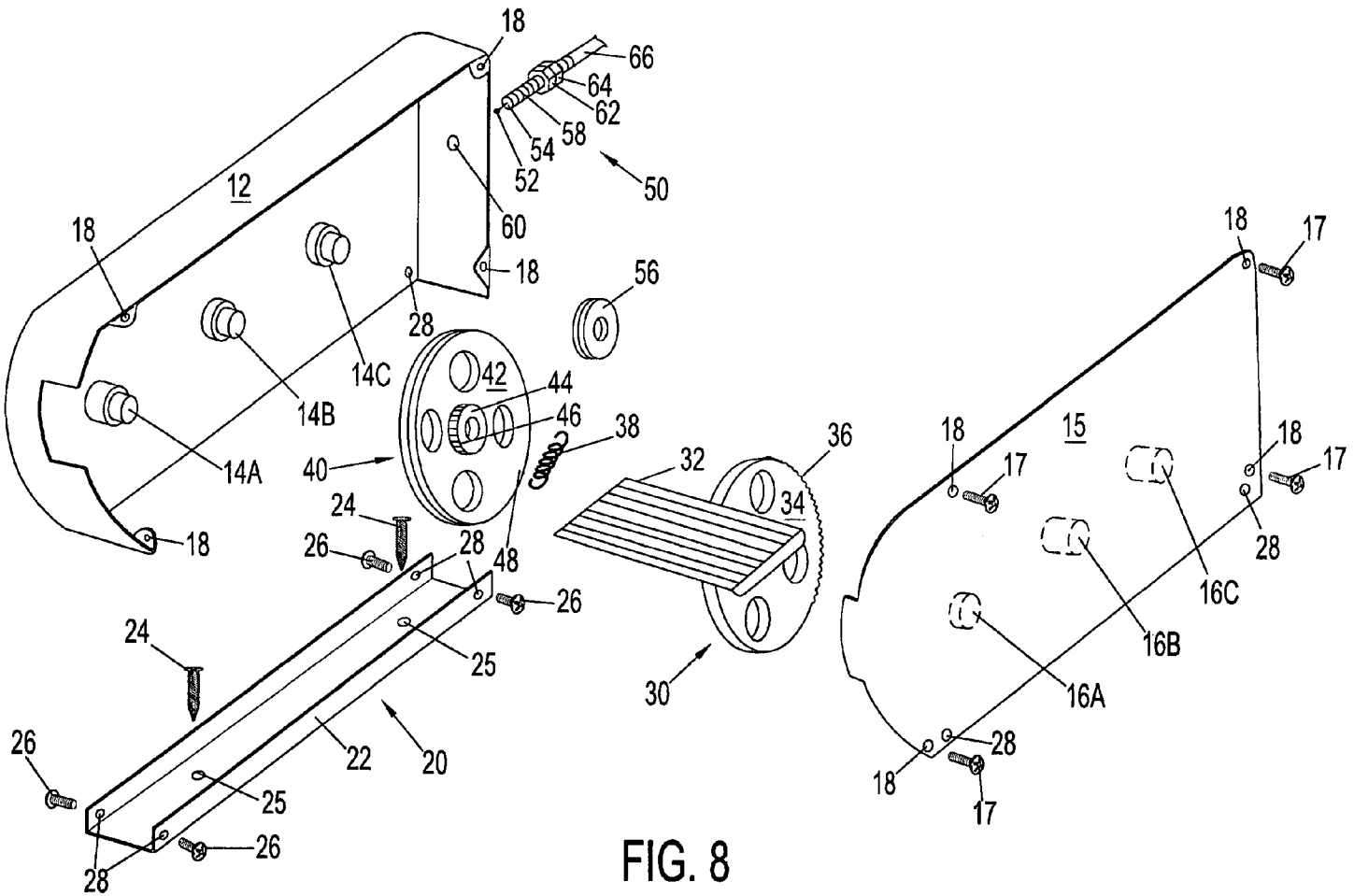
FIG. 8 is a exploded view of the foot pedal housing unit.

FIG. 8 illustrates an exploded view of the housing assembly 10. To the far upper left of the illustration is the housing body 12 shown at a 45° angle. The housing body 12 is approximately 19 cm (7.5 inches) in length, 9 cm (3.5 inches) in height, and 3 cm (1.2 inches) in width. One end has a notch removed to allow for the up and down movement of the arm 33 while the other end has a hole 60 to allow for the insertion of the adjustment arm assembly 50. Positioned along the inside wall and in a horizontal line are three (3) mounted axles 14A, 14B, and 14C. With this embodiment the axles 14A, 14B, and 14C are combined with spacer guides as one unit for simplicity of design. The middle axle 14B and rear axle 14C are evenly and equally spaced so as to insure alignment of the cable pulley 42 and cable guide pulley 56. The forward axle 14A is spaced so as to allow the drive gear teeth 36 to align with the spur gear teeth 46 when mounted and assembled. The housing body 12 has a gaff 37 located along the forward inner wall above axle 14A for the drive gear spring 38 to connect to. Also demonstrated here in FIG. 8 is the valley groove along the outer edge of the cable pulley 42 and the cable guide pulley 56 to allow for alignment of the cable 54. To the far right of the illustration is the cover plate 15. Along the inner wall and in a horizontal line are spacer guides 16A, 16B, and 16C shown in phantom lines. Located to the far left and bottom of the illustration is a anchor plate assembly 20 demonstrating alignment of its floor screws 24 and its housing mount screws 26. Another novel feature evident here is the simplicity of design thereby eliminating the need for numerous and costly parts.

Operational Description of Preferred Embodiment

The various elements of the system 100 interact as follows to provide a foot actuated toilet seat or seat/lid lifting and self-lowering mechanism. Referring now to FIG. 5C, the illustration demonstrates that as force is applied to the foot pedal 32, causing the downward motion indicated by Arrow A, the arm 33 transmits the force and causes the drive gear assembly 30 to turn in a counter clock-wise direction on its axis, as indicated by Arrow B. The drive gear teeth 36 that mesh with the spur gear teeth 46 causes the raised spur gear 44 to engage the cable pulley 42 in a clock-wise direction on its axis, as indicated by Arrow C. As the cable pulley assembly 40 rotates about on its axis the attached cable 54 follows this direction over the guide pulley 56 which turns in a counter clock-wise direction on its axis, and is indicated by Arrow D. The simultaneous interaction of the drive gear assembly 30 and the pulley assembly 40 causes the cable 54 to retract from its opposite end where the lift arm assembly 70 is located. Referring now to the illustrations in FIGS. 3 and 4B, as the cable 54 retracts into the cable sleeve 66 the pressure initially applied to the foot pedal 32 and transferred through the retraction of the cable 54 causes compression pressure to the lift arm 90. The compression pressure applied to the lift arm 90 is distributed between two (2) points which are the hinge 94A and the roller pin 96. As the compression pressure increases the force causes the hinge 94B up in a collapsing motion of the lift arm 90 providing the lifting point for the toilet seat 102. When the lift arm 90 reaches its maximum retracted position the toilet seat 102 will assume an up position which is approximately 75° to 80° relative to the toilet bowl rim 116. With the removal of the applied force from the foot pedal 32 the weight of the toilet seat 102, aided by gravity, forces the lift arm 90 down causing it to unfold and return to rest position. As the cable 54 retracts from the housing assembly 10 the drive gear spring 38 aids in returning the foot pedal/arm/drive gear assembly 30 and the cable pulley assembly 40 to their respective resting positions.

Manufacturing Assembly of Preferred Embodiment

Referring now to FIG. 8, assembly would start with;

A) the housing body 12 lying flat with the axles 14A, 14B, and 14C in an straight up position. This embodiment employs mounted axles combined with spacer guides and because axles 14B and 14C are evenly and equally spaced all that would be required would be to mount the cable pulley 42 onto the middle axle 14B and the cable guide pulley 56 onto the rear axle 14C. The cable end connector 52, the cable 54, and the adjustment arm 58 would then be inserted through the adjustment arm hole 60. The cable 54 would be guided over the top of the cable guide pulley 56 and then down towards the bottom of the cable pulley 42 wherein the cable end connector 52 would be inserted into the cable end connector slot 48. Next, the drive gear spring 38 would need to be connected to the drive gear spring housing body connector/gaff 37 located along the inner wall above the front axle 14A and then connected to the drive gear spring wheel connector/gaff 39 (not shown) as the drive gear wheel 34 is being mounted onto the front axle 14A. Also, as the drive gear wheel 34 is being mounted, the drive gear teeth 36 would need to be simultaneously aligned to mesh with the spur gear teeth 46. Axle 14A is predeterminedly spaced so as to insure the alignment of the drive gear teeth 36 and the spur gear teeth 46. Lastly, the cover plate 15 would need to be placed over the housing body 12 wherein the spacer guides 16A, 16B, and 16C would provide a barrier to keep the assembled parts in their respective positions. Also, the mounted pulleys would be journaled with suitable bearings or bushings.

B) the anchor plate assembly 20 would be kept separate and placed with its associated parts in a blister pack.

C) the lift arm assembly 70 would only require the opposite end of the cable 54 being guided through the mounted cable end eye 78, then through the lift arm cable eye 92 where the cable 54 would be connected to the lift arm 90 by the cable end connection 98, which is a reinforced gaff designed for the looped cable end, thereby completing assembly.

Consumer Installation Procedure

Installation would begin with;

A) the positioning of the housing assembly 10 determined by the consumer's choice. Once a desired position is located, the anchor plate 22 would need to be anchored. If the floor 120 is wood, there would be two (2) screws 24 provided and all that would be required would be to securely fasten the anchor plate 22 by installing the screws 24. If the floor 120 is concrete, tile, marble, or some other form of sedimentary compound, two (2) holes would need to be drilled first for the placement of screw tappits, which would be included in the blister packs.

B) once the anchor plate 22 is securely fastened down, the housing body 12 would be placed over the anchor plate 22 (reference FIG. 5B) wherein the mounting screws 26 could be inserted, thereby completing the housing assembly 10 installation (reference FIG. 5A).

C) next, referring now to FIG. 7, the lift arm assembly 70 would need to be installed. First, the toilet seat attachment bolts 108 would need to be removed from the toilet seat attachment brackets 110 which are connected by toilet seat hinges 106 and would then allow the toilet seat 102 and the lid 104 to be removed. The lift arm assembly 70 would then be placed on top of the toilet bowl rim 116 in a horizontal position where the brace plate holes 74 would line up with the toilet seat/lid attachment bracket 110 holes. Once the brace plate holes 74 are aligned, the lift arm 90 would need to be properly positioned along the toilet bowl rim 116 and then secured in place by fastening the swing arm adjustment nut 86. After securing the swing arm bracket 80, the safety cap 88 would need to be placed over the extension 76 aligning the bolt 108 holes. The toilet seat 102 and the lid 104 would be returned to its original position wherein the toilet seat attachment bolts 108 could be returned and fastened to the toilet seat attachment nuts 112, thereby completing the installation procedure.

Conclusions, Ramifications, and Scope

The disclosed foot actuated toilet seat or seat/lid lifting and self-lowering mechanism provides a simple, readily installable, ergonomically advanced, and safe mechanism that manufacturers and the general public will readily accept and utilize. Furthermore, because of its simplistic design, the low cost of manufacturing and distribution will render this mechanism commercially viable allowing its utilization both in domestic and commercial applications. The entire assembly can be produced from simple cut and bent metal parts and can be marginally modified to provide other potential uses without departing from the spirit or scope of the appended claims.

While the disclosed foot actuated toilet seat or seat/lid lifting and self-lowering mechanism contains many specificities and subordinate devices and assemblies, these should not be construed as limitations on the scope of the disclosed mechanism or scope of use for the subordinate devices or assemblies, but rather as an exemplification of one preferred embodiment for one particular application. Many other variations and applications are possible.

Thus, the scope of the disclosed mechanism should be determined by the appended claims and their legal equivalents, and not by the examples given.

I claim:

1. A foot actuated toilet seat or seat/lid lifting and self-lowering mechanism, comprising:

(a) a housing assembly providing means for rotational energy, said housing assembly composed of a enclosed casing of rigid material having a predetermined prolated rectangular shape with a plurality of pintles mounted inside for pivotably mounting two contiguous circular members, said first circular member having a tortuous arm on one side protruding through an aperture of said housing body to a predetermined position providing connection for a small planar member horizontally positioned in a predetermined fashion, said first circular member having a opposite side wherein a plurality of cogs mesh with a spur gear composed of a plurality of cogs projecting outwardly from said second circular member, said second circular member securing connection to a cable assembly;

b) a cable assembly composed of a flexible elongated core-element sheathed inside a semi-rigid elongated holder surrounding and encasing said flexible core-element, said core-element providing means for coupling rotational energy from said housing assembly to a lift arm assembly;

c) a lift arm assembly composed of two contiguous planar members sandwiched between a toilet seat and a toilet bowl rim, said first planar member being immobilized by seat attachment bolts securing stabilization for said second planar member coupled by a arbor, said second planar member having two hinges placed in a predetermined position, said hinges providing means for lifting at the apex with the urging of applied force supplied by said rotational energy;

said housing assembly providing rotational energy conveyed by said cable assembly to said lift arm assembly, said rotational energy providing means for lifting of said toilet seat.

* * * * *